US007153417B2

(12) United States Patent
Happel

(10) Patent No.: US 7,153,417 B2
(45) Date of Patent: Dec. 26, 2006

(54) FLOATING STORM WATER DRAIN BASKET

(76) Inventor: Henry Happel, 140 Ruby St., Rockledge, FL (US) 32955

( * ) Notice: Subject to any disclaimer, the term of this patent is extended or adjusted under 35 U.S.C. 154(b) by 112 days.

(21) Appl. No.: 11/092,950

(22) Filed: Mar. 30, 2005

(65) Prior Publication Data

US 2005/0218049 A1 Oct. 6, 2005

Related U.S. Application Data

(60) Provisional application No. 60/559,284, filed on Apr. 5, 2004.

(51) Int. Cl.
*E03F 5/14* (2006.01)

(52) U.S. Cl. ..... 210/122; 210/154; 210/163; 210/242.1; 210/162; 404/4

(58) Field of Classification Search ..... 210/122, 210/154, 156, 162, 163, 170, 242.1, 448; 404/4, 5

See application file for complete search history.

(56) References Cited

U.S. PATENT DOCUMENTS 222,140 A * 12/1879 Lindsay ..... 210/242.1
2,497,177 A * 2/1950 McClintock et al. ..... 210/154
3,756,410 A * 9/1973 Moody et al. ..... 210/242.1
4,689,145 A * 8/1987 Mathews et al. ..... 210/170
4,695,376 A * 9/1987 Astrom et al. ..... 210/242.1
5,104,528 A * 4/1992 Christie ..... 210/122
5,108,593 A * 4/1992 D'Ascensio et al. ..... 210/242.1
5,562,819 A * 10/1996 Turner et al. ..... 210/162
6,379,541 B1 4/2002 Nicholas
6,428,692 B1 8/2002 Happel
2003/0085166 A1* 5/2003 Dreyer et al. ..... 210/170

* cited by examiner

*Primary Examiner*—Christopher Upton
(74) *Attorney, Agent, or Firm*—William M. Hobby, III

(57) ABSTRACT

A storm water filter system apparatus includes a housing having an inlet and an outlet and has a floating filter basket therein having an open end portion. A scoop formed on the front end of the filter basket is positioned to face the inlet to the housing. The filter basket has a least one float attached thereto in a position to float the filter basket in water in the housing to position the filter basket open end and scoop in front of the housing inlet and at least partially above the water level in the housing to capture floating debris from the entering storm water so that the floating filter basket adjusts for varying water levels in the housing.

12 Claims, 2 Drawing Sheets

FLOATING STORM WATER DRAIN BASKET

This application claims the benefit of U.S. Provisional Application No. 60/559,284, filed Apr. 5, 2004.

BACKGROUND OF THE INVENTION

The present invention relates to a storm water drain filter system and especially to a storm water drain pipe filter system having a floating debris capturing basket for collecting debris from entering storm water.

Storm water runoff passing through a storm water drain-pipe passes through the filter basket prior to the storm water drain water passing through an outlet into the storm water pipe. The drain water, which is frequently laden with trash, grass clippings, tree limbs, sand, gravel, and other forms of sediment, is collected from streets, parking lots and other areas into a storm drain inlet where it is directed into a storm water drain pipe system. The drain water laden with trash and grass clippings, sand and gravel and frequently oil collected from the streets is fed through a grated entrance into a storm water catch basin and into a lake or retention pond.

The present invention is added directly to the storm water drain pipe system in-line with the drain pipes for collecting trash, grass clippings, tree limbs, sand, gravel, or other sorts of sediments within the drain water passing through the drain pipe system prior to the output of the drainage water. The present invention is a floating collection basket for use in an in-line storm sewer drain filter system for the removal of litter and sediments from a flowing stream of storm water.

In my prior U.S. Pat. No. 6,428,692 of Aug. 6, 2002, I provided an in-line storm water drain filter and baffle box installed within a storm water drain pipe to direct storm water through the storm water drain pipe and through the filter and baffle box prior to the storm water drain water passing through an outfall into a, lake, pond or retention area. In the Nicolas U.S. Pat. No. 6,379,541, a storm water sediment and litter trap for removal of litter and sediment from a flowing stream of storm water is provided which has an upwardly inclined flume disposed adjacent a discharge end of a storm water outlet and a collection container at the opposite end of the flume for collecting sediments while allowing storm water, which has been screened, to flow further downstream.

SUMMARY OF THE INVENTION

A storm water filter system apparatus includes a housing having an inlet and an outlet and a plurality of supporting posts mounted therein. A filter basket has an open end portion and has a scoop formed on the front end thereof. The filter basket is positioned in the housing with the open end portion and scoop facing the inlet to the housing. The filter basket movably attaches to the post and receives storm drain water from the housing inlet. The filter basket has at least one float attached thereto in a position to float the filter basket in water in the housing to position the filter basket open end and scoop in front of the housing inlet and at least partially above the water level in the housing to capture floating debris from the entering storm water so that the floating filter basket adjusts for varying water levels in the housing. The filter basket may have a pair of floats, one on each side thereof, and four posts supporting and guiding the filter basket as it floats up and down with the water level in the housing. The scoop is angled downward to collect debris entering the inlet with the storm water and ramping the debris into the collection basket portion of the filter basket. A plurality of basket supports are also mounted in the housing to support the basket in a position with the scoop adjacent the bottom edge of the inlet when the water level in the housing drops to a predetermined level so that the water entering the inlet will always have the floating storm water filter basket positioned to collect floating debris in the storm water entering the housing. A plurality of baffles are mounted in the housing to act as turbulence deflectors and for collecting sediment therebetween but can also act as or have formed thereon the filter basket support. The housing can have one or move removable covers to allow entrance into the housing above the filter basket for the removal of collected debris in the basket.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 5:
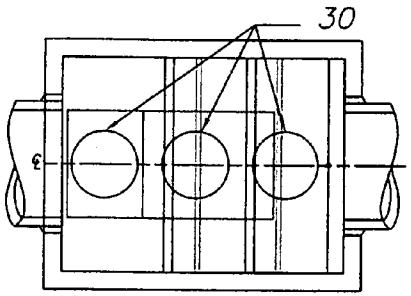
FIG. 5 is a top elevation of the storm water pipe filter system of FIGS. 1–4.
Figure 4:
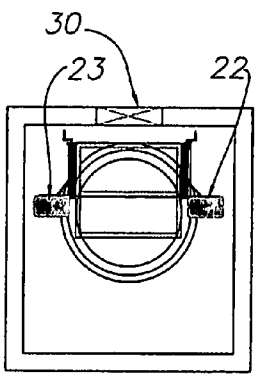
FIG. 4 is a right end view of a storm water pipe filter of FIGS. 1–3.
Figure 3:
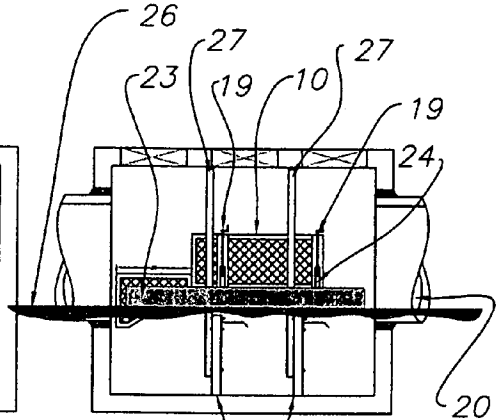
FIG. 3 is another sectional view of the storm water pipe filter system of FIGS. 1 and 2.
Figure 2:
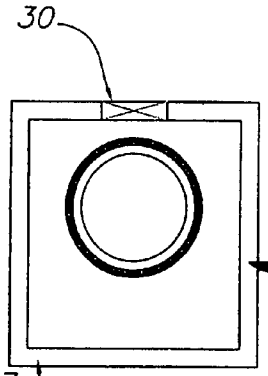
FIG. 2 is a left end view of the storm water filter of FIG. 1.
Figure 1:
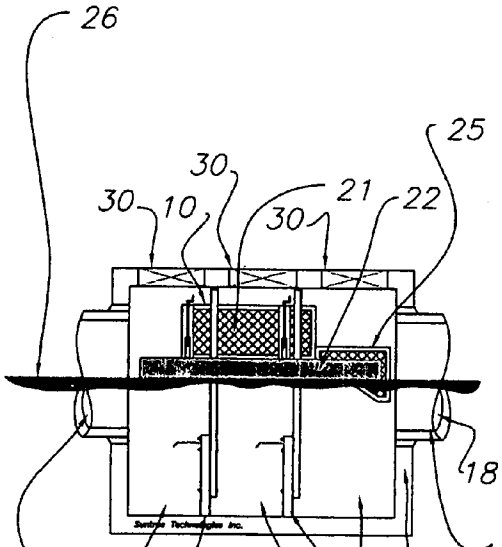
FIG. 1 is a sectional view taken through a storm water pipe having a filter system in accordance with the present invention.
Figure 6:
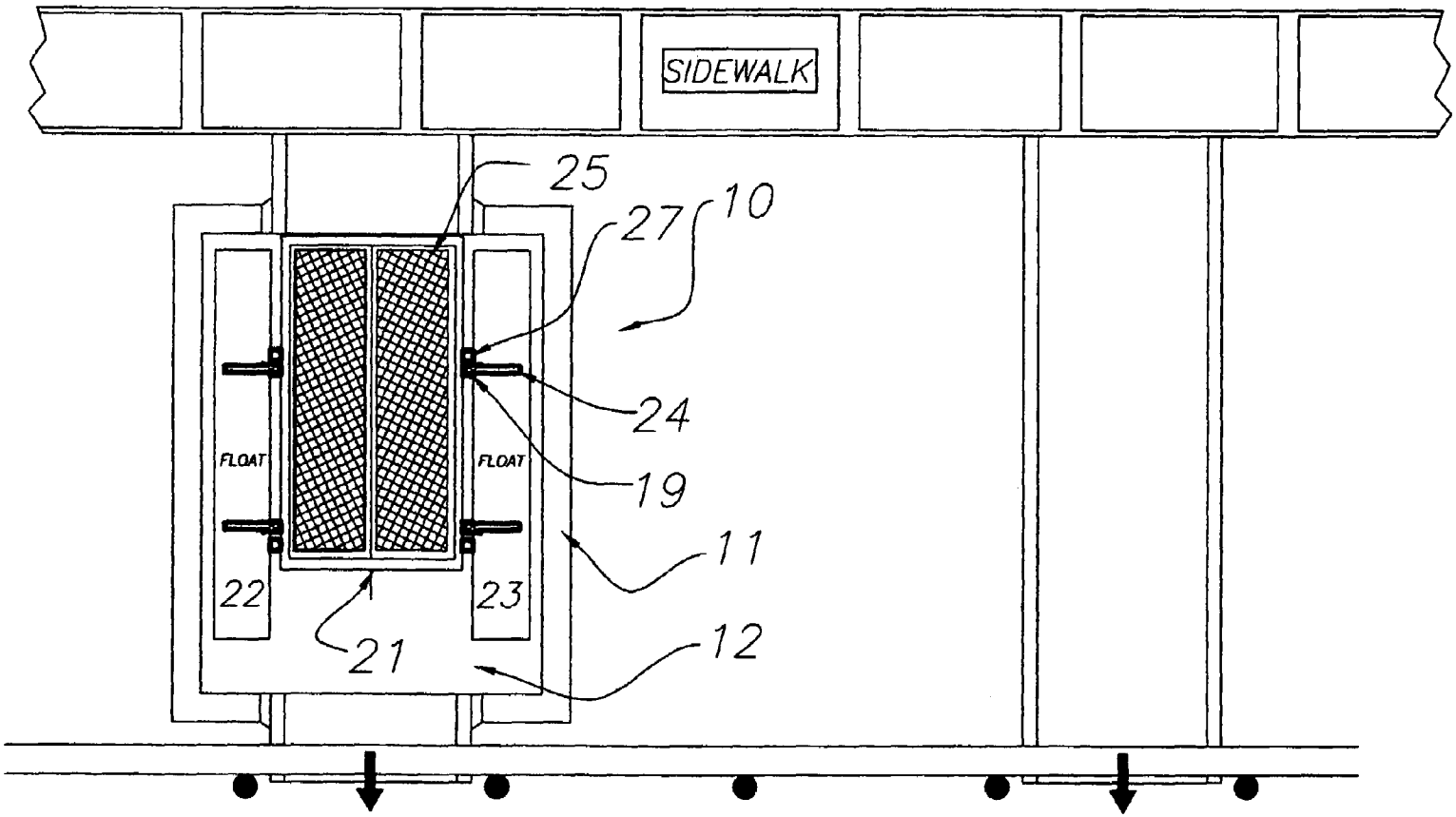
FIG. 6 is a top sectional view of the storm water pipe filter system of FIGS. 1–5.

Referring to FIGS. 1–6, a storm water pipe filter system 10 is illustrated having a housing 11 and three chambers 12, 13, and 14 separated by a pair of baffles 15 and 16. The housing 11 is connected into a storm water pipe 17 and has an inlet 18 and an outlet 20. During the storm water flow through the storm water pipe 17, the storm water with debris enters the inlet 18 of the housing 11. A debris collection basket 21 is mounted to a pair of floats 22 and 23 using a plurality of connectors 19 attached to the debris collection basket 21 which is connected to bars 24 attached in each of the floats 22 and 23. The debris collecting basket 21 has a front scoop portion 25 on the front part thereof and which extends down between the floats 22 and 23. The present in-line storm water drain filter system is used in an in-line storm water drain pipe filter system having varying water levels 26, such as in tidal water areas. FIG. 1 shows the tidal level or water level within the drain pipe at high tide and FIG. 3 shows the water level at low tide. As the tide or water level varies, the floats 22 and 23 raise and lower the debris collection basket 21 and the front scoop 25. A plurality of posts 27 are attached to the baffles 15 and 16 and extend upward between the floats 22 and 23 and the basket 21 to thereby guide the floats and basket as they are raised and lowered with the varying water level 26. The varying water level raises and lowers the floats with the basket 21 and varies the position of the scoop 25 so that the scoop 25 is always in alignment with the inlet 18 from the storm water pipe 17 along the water level of the existing water. The storm water passing through the storm water pipe 17 enters the inlet 18 and flows immediately into the scoop 25 which is inclined and forces the debris and litter thereinto and up into the collection basket 21. The collection basket 21 and the scoop 25 are fabricated from an expanded metal mesh screen so that water passes therethrough along with fine sand, grit and the like into the baffle chambers 12, 13, and 14 where they are collected. The liquid passes through the chambers and over the baffles before it flows out the outlet 20.

The rapid flow of storm water entering the inlet 18 forces the debris into the scoop 25 and up the incline into the collection basket 21. In addition, the force of the incoming water forces a slight tilt into the floats 22 and 23 along with the allowing the scoop 25 to tilt downward slightly to aid in forcing the debris into the basket. Once the storm water has been screened through the screen in the scoop 25 and basket 21 and has passed through the baffled chambers and solids have collected in the chambers 12, 13, and 24, the storm water is permitted to flow further downstream when passing out the outlet 20. The housing 11 has three inlets 30 in the top thereof which are easily removed for cleaning the basket 21 and for getting a vacuum hose into the chambers 12, 13 and 14 if desired. As can be seen, the basket 21 with the scoop 25 rises on the floats 22 and 23 and are constantly changing the positioning of the basket 21 in accordance with the water level so that the scoop 25 collects all of the floating debris and litter thereinto and scoops it into the basket 21. The basket 21 rides on the floats 22 and 23 and is maintained above the water level so that debris, such as grass clippings, leaves, and the like, do not rot but rather dry out and can be easily removed from the basket through the openings 30.

It should be clear that the present invention discloses a filter system for the removal of litter and sediments from a flowing stream of storm water and it is especially useful in areas where tide water or ground water levels vary to vary the water levels within a storm water filter system. However, the present invention is not to be construed as limited to the forms shown which are considered illustrative rather than restrictive.

I claim:

1. A storm water filter system comprising:

a housing having an inlet thereinto and an outlet therefrom;

at least one post mounted in said housing;

a filter basket having an open end portion and being positioned in said housing with said open end portion facing said inlet, said filter basket being movably attached to said post to receive storm drain water from said inlet;

at least one float attached to said filter basket at a position to float said filter basket in water in said housing to position said filter basket opening in front of said housing inlet and at least partially above said water level to capture floating debris from said entering storm water;

whereby a floating filter basket adjusts for varying water levels in said housing.

2. A storm water filter system in accordance with claim 1 a pair of floats, one positioned on either side of said filter basket.

3. A storm water filter system in accordance with claim 1 in which said filter basket includes a scoop adjacent the opening thereinto for directing debris from said entering storm water into said filter basket whereby said filter basket has a collection basket portion having a front mounted scoop.

4. A storm water filter system in accordance with claim 3 in which said scoop is angled downward from said collection basket portion.

5. A storm water filter system in accordance with claim 3 in which said housing has a plurality of basket supports therein to support said filter basket scoop adjacent a bottom edge of said inlet when said water level in said housing drops to a predetermined level.

6. A storm water filter system in accordance with claims 5 in which said housing has a plurality of baffles therein positioned below said filter basket.

7. A storm water filter system in accordance with claim 6 in which each basket support is formed on a baffle.

8. A storm water filter system in accordance with claim 7 said housing has at least two posts therein, each post being attached to one of said plurality of housing baffles.

9. A storm water filter system in accordance with claim 1 in which said filter basket has an open top and a screened sides and bottom.

10. A storm water filter system in accordance with claim 9 in which said housing has at least one removable cover in the top thereof allowing entrance into said housing above said filter basket for the removal of collected debris in said basket.

11. A storm water filter system in accordance with claim 1 in which said housing has at least two posts therein.

12. A storm water filter system in accordance with claim 1 in which said housing has four posts therein.

* * * * *